US011272578B2

(12) United States Patent
Robert et al.

(10) Patent No.: US 11,272,578 B2
(45) Date of Patent: Mar. 8, 2022

(54) HEATING ASSEMBLY, AEROSOL-GENERATING DEVICE AND A METHOD FOR HEATING AN AEROSOL-FORMING SUBSTRATE

(71) Applicant: PHILIP MORRIS PRODUCTS S.A., Neuchatel (CH)

(72) Inventors: Jacques Robert, Le Mont-sur-Lausanne (CH); Jean-Yves Vollmer, Fountaines-sur-Grandson (CH); Michel Bessant, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 267 days.

(21) Appl. No.: 16/348,593

(22) PCT Filed: Nov. 17, 2017

(86) PCT No.: PCT/EP2017/079535
§ 371 (c)(1),
(2) Date: May 9, 2019

(87) PCT Pub. No.: WO2018/091627
PCT Pub. Date: May 24, 2018

(65) Prior Publication Data

US 2019/0269174 A1 Sep. 5, 2019

(30) Foreign Application Priority Data

Nov. 18, 2016 (EP) ..... 16199649

(51) Int. Cl.
*H05B 3/44* (2006.01)
*A24F 40/46* (2020.01)
(Continued)

(52) U.S. Cl.
CPC ..... *H05B 3/04* (2013.01); *A24F 40/46* (2020.01); *A24F 40/50* (2020.01); *A24F 42/10* (2020.01);
(Continued)

(58) Field of Classification Search
CPC ..... A24F 40/50; A24F 40/46; A24F 42/10; A24F 40/00; A24F 40/20; A24F 40/57; H05B 11/00
See application file for complete search history.

(56) References Cited

U.S. PATENT DOCUMENTS 7,726,320 B2 6/2010 Robinson
8,851,083 B2 10/2014 Oglesby
(Continued)

FOREIGN PATENT DOCUMENTS

CN 1570626 A 1/2005
CN 101557728 A 10/2009
(Continued)

OTHER PUBLICATIONS

PCT Search Report and Written Opinion for PCT/EP2017/079535 dated Mar. 1, 2018 (14 pages).
(Continued)

*Primary Examiner* — Jean F Duverne
(74) *Attorney, Agent, or Firm* — Mueting Raasch Group

(57) ABSTRACT

The present invention relates to a heating assembly (10) of an aerosol-generating device for heating aerosol-forming substrate. The heating assembly comprises a chemical heating device (200) configured to generate primary heat by an exothermic chemical reaction and to supply the primary heat to an aerosol-forming substrate for heating the substrate. The heating assembly further comprises an electrical heating device (100) configured to electrically generate and supply secondary heat to the aerosol-forming substrate for heating
(Continued)

the substrate. The invention further relates to an aerosol-generating device including such a heating assembly. A method for generating an aerosol by heating aerosol-forming substrate comprises at least one of a sequential or a parallel performance of the following steps: generating primary heat by an exothermic chemical reaction and supplying the primary heat to the aerosol-forming substrate for heating the substrate; and electrically generating secondary heat and supplying the secondary heat to the aerosol-forming substrate for further heating the substrate.

13 Claims, 5 Drawing Sheets

(51) Int. Cl.

| | |
|---|---|
| ***A24F 40/50*** | (2020.01) |
| ***A24F 42/10*** | (2020.01) |
| ***A24F 40/00*** | (2020.01) |
| ***A24F 40/57*** | (2020.01) |
| ***H05B 3/04*** | (2006.01) |
| *A24F 40/20* | (2020.01) |

(52) U.S. Cl.
CPC ..... *H05B 3/44* (2013.01); *A24F 40/00* (2020.01); *A24F 40/20* (2020.01); *A24F 40/57* (2020.01); *H05B 2203/021* (2013.01); *H05B 2203/022* (2013.01)

(56) References Cited

U.S. PATENT DOCUMENTS

| | | | | |
|---|---|---|---|---|
| 9,055,617 | B2 | 6/2015 | Thorens | |
| 9,918,494 | B2 | 3/2018 | Mironov | |
| 10,010,112 | B2 | 7/2018 | Silvestrini | |
| 10,149,495 | B2 | 12/2018 | Mironov | |
| 10,368,574 | B2 | 8/2019 | Mironov | |
| 10,448,670 | B2 | 10/2019 | Talon | |
| 2007/0074389 | A1 | 4/2007 | Earls | |
| 2009/0074389 | A1 | 3/2009 | Noe | |
| 2013/0220316 | A1 | 8/2013 | Oglesby | |
| 2014/0096781 | A1* | 4/2014 | Sears | A24F 40/53 131/328 |
| 2014/0186015 | A1 | 7/2014 | Breiwa, III | |
| 2014/0253144 | A1* | 9/2014 | Novak, III | A24F 40/40 324/550 |
| 2015/0053219 | A1* | 2/2015 | Roudier | A24F 42/10 131/329 |
| 2016/0331031 | A1* | 11/2016 | Malgat | A24C 5/01 |
| 2016/0331032 | A1* | 11/2016 | Malgat | A24D 1/20 |
| 2017/0020191 | A1* | 1/2017 | Lamb | A61M 11/042 |
| 2020/0253278 | A1* | 8/2020 | Schneider | A24F 40/50 |

FOREIGN PATENT DOCUMENTS

| | | | |
|---|---|---|---|
| CN | 101889472 | A | 11/2010 |
| CN | 102753047 | A | 10/2012 |
| CN | 203388265 | U | 1/2014 |
| CN | 103549657 | | 2/2014 |
| CN | 103653257 | A | 3/2014 |
| CN | 103720056 | A | 4/2014 |
| CN | 103997921 | A | 8/2014 |
| DE | 19854008 | | 5/2000 |
| EP | 1891867 | | 2/2008 |
| GB | 2513638 | A | 11/2014 |
| JP | 2008-043290 | | 2/2008 |
| JP | 2008-535530 | | 9/2008 |
| JP | 2015-509709 | | 4/2015 |
| JP | 2016-500274 | | 1/2016 |
| JP | 2016-508744 | | 3/2016 |
| JP | 2016-521977 | | 7/2016 |
| WO | WO 2007/012007 | | 1/2007 |
| WO | WO 2009/155957 | | 12/2009 |
| WO | WO 2009/156181 | | 12/2009 |
| WO | WO 2011/050964 | | 5/2011 |
| WO | WO 2014/037259 | | 3/2014 |
| WO | WO 2014/045024 | | 3/2014 |
| WO | WO 2014/102091 | | 7/2014 |

OTHER PUBLICATIONS

Office Action issued in China for Application No. 2021041601991050 dated Apr. 21, 2021 (6 pages).
Office Action issued in Japan for Application No. 2019-520697 dated Nov. 15, 2021 (6 pages). English translation included.

* cited by examiner

HEATING ASSEMBLY, AEROSOL-GENERATING DEVICE AND A METHOD FOR HEATING AN AEROSOL-FORMING SUBSTRATE

This application is a U.S. National Stage Application of International Application No. PCT/EP2017/079535 filed Nov. 17, 2017, which was published in English on May 24, 2018, as International Publication No. WO 2018/091627 A1. International Application No. PCT/EP2017079535 claims priority to European Application No. 16199649.1 filed Nov. 18, 2016.

The present invention relates to a heating assembly, an aerosol-generating device and a method for generating an aerosol by heating an aerosol-forming substrate.

There are aerosol-generating devices in which aerosol-forming substrates are heated by a heating assembly within the device to form an inhalable aerosol of a substance evaporated from the substrate upon heating. Many aerosol-generating devices comprise resistive electrical heaters to generate thermal energy for heating the substrate. However, resistive heating may be accompanied by high energy consumption, thus limiting a time of operation of devices using battery driven heaters. Other aerosol-generating devices comprise chemical heaters utilizing the heat release of exothermic chemical reactions for heating the substrate. For example, such chemical heaters may be solid fuel heaters or catalytic heaters. Though typically providing high energy densities, the chemical reaction and thus the heat release of chemical heaters may be difficult to control.

Therefore, it would be desirable to have a heating assembly, an aerosol-generating device and a corresponding method with the advantages of prior art solutions but without their limitations. In particular, it would be desirable to have such products and such a method, providing a controllable and energy-efficient heating of aerosol-forming substrate.

According to the invention there is provided a heating assembly of an aerosol-generating device for heating an aerosol-forming substrate. The heating assembly comprises a chemical heating device configured to generate primary heat by an exothermic chemical reaction and to supply the primary heat to the aerosol-forming substrate for heating the substrate. The heating assembly further comprises an electrical heating device configured to electrically generate and supply secondary heat for heating the substrate.

As including two different heating devices, the heating assembly according to the invention may be understood to be a hybrid heating device providing a hybrid solution for heating an aerosol-forming substrate, taking the advantages of both heating devices. The chemical heating device provides a heat source with high energy density, thus allowing efficient generation of primary heat, which for example may be used for an initial heating or a coarse heating of the aerosol-forming substrate. The electrical heating device provides secondary heat in a well controllable way, in particular allowing for a precise heating of the substrate to a target temperature. The target temperature preferably corresponds to a desired temperature of the aerosol-forming substrate for generating an aerosol.

In general, the heating assembly may be configured for parallel use of the chemical heating device and the electrical heating device for parallel or combined heating of the aerosol-forming substrate. Preferably, the chemical heating device may be configured to generate and supply primary heat to the aerosol-forming substrate for heating the substrate to a pre-target temperature, and the electrical heating device may be configured to generate and supply secondary heat in addition to the primary heat for further heating the aerosol-forming substrate to a target temperature beyond the pre-target temperature. Thus, the heating assembly may be configured for using the chemical heating device and the electrical heating device in combination in order to reach the target temperature. In particular, due to the good controllability of the electrical heating device, parallel use of the chemical heating device and the electrical heating device allows for precisely controlling the temperature of the aerosol-forming substrate by a controlled supply of secondary heat in addition to the primary heat.

Alternatively or additionally, the heating assembly may be configured for sequential use of the chemical heating device and the electrical heating device for sequentially heating the aerosol-forming substrate, in particular during different phases of generating an aerosol. According to this, the heating assembly may be configured to use the chemical heating device for heating the aerosol-forming substrate during one phase of generating an aerosol, and to use the electrical heating device for heating the aerosol-forming substrate during another phase of generating an aerosol. In particular, the heating assembly may be configured to heat the aerosol-forming substrate to different temperatures during different phases using either one of the chemical heating device and the electrical heating device, which allows for controlling the generation of aerosol over time. As an example, the heating assembly may be configured for heating the aerosol-forming substrate according to a first temperature profile using the chemical heating device during a first phase of aerosol generation, and for heating the aerosol-forming substrate according to a second temperature profile using the electrical heating device during a second phase of aerosol generation. The first and second temperature profiles may be such that the temperature increases from an initial temperature to a first temperature during the first phase, and drops below the first temperature and then again increases during the second phase.

In general, the heating assembly may be configured for sequential use of the chemical heating device and the electrical heating device in any sequence. For example, the heating assembly may be configured such as to first use the chemical heating device and to subsequently use the electrical heating device, or vice versa.

As used herein, the terms "primary heat" and "secondary heat" are meant to be nominal terms allowing for differentiating between heat originating from the chemical heating device and heat originating from the electrical heating device. The terms do not have to embody any quantitative relation. Primary heat and secondary heat constitute a first amount and a second amount of thermal energy, respectively, that may be used in combination or sequentially.

Preferably in case of using the chemical heating device and the electrical heating device in combination, the primary heat provided or providable by the chemical heating device may be larger than the secondary heat provided or providable by the electrical heating device.

Accordingly, the chemical heating device may be configured to generate a basic amount or a major amount of heat for heating the aerosol-forming substrate, whereas the electrical heating device may be configured to generate a supplementary or minor amount of heat in addition to, but smaller than the basic/main/major amount of heat provided or providable by the chemical heating device.

Preferably, the chemical heating device is configured for coarse heating or for a coarse adjustment of the temperature of the aerosol-forming substrate, whereas the electrical heating device may be configured for fine heating or for a fine adjustment of the temperature of the aerosol-forming substrate.

A temperature difference between a pre-target and a target temperature may be smaller than the temperature difference between the pre-target temperature and an initial temperature of the aerosol-forming substrate before heating. An initial temperature of the aerosol-forming substrate may, for example, be room temperature. Advantageously, the pre-target temperature may be any temperature between 200° C. and 280° C., in particular between 240° C. and 260° C., preferably about 250° C. The target temperature may typically be any temperature between 300° C. and 350° C.

The generation of primary heat may be limited to a pre-target temperature well below a target temperature so that a complete shut-off of secondary heat will be enough to easily reduce the actual temperature to reasonable temperatures in case of overheating. The chemical heating device may be configured to allow for presetting the generation of primary heat, in particular for limiting the generation of the primary heat to a preset limit.

Of course, the primary heat provided or providable by the chemical heating device may also be smaller than or equal to the secondary heat provided or providable by the electrical heating device. Accordingly, the temperature difference between the pre-target and the target temperature may be larger than or equal to the temperature difference between the pre-target temperature and an initial temperature of the aerosol-forming substrate.

The heating assembly may comprise a controller that is operatively connected at least to the electrical heating device for controlling the temperature of the aerosol-forming substrate. Due to its high degree of controllability, the electrical heating device is the preferred actuating element used for controlling the temperature of the aerosol-forming substrate. In particular, the electrical heating device may be used to adjust the temperature of the aerosol-forming substrate to a target temperature.

The chemical heating device may also be used to control the temperature of the aerosol-forming substrate. For this, the controller may also be operatively connected to the chemical heating device. However, as chemical heating devices are typically less controllable than electrical heating devices, the chemical heating device is preferably only used for a coarse control or for a slow control of the temperature of the aerosol-forming substrate or for a coarse and slow control of the temperature of the aerosol-forming substrate. Slow control may comprise a control over longer timescales, for example longer than 10 seconds. In contrast to this, the electrical heating device is preferably used for a fine control or a fast control of the temperature of the aerosol-forming substrate or for a fine control and fast control of the temperature of the aerosol-forming substrate, in particular over short timescales.

At least with regard to the control of secondary heat, the controller preferably is a closed-loop controller relying on a measurement of a temperature that is indicative of the actual temperature of the aerosol-forming substrate. For this, the heating assembly may comprise at least one temperature sensor operatively connected to the controller. The temperature sensor may be a separate temperature sensor that—in use of the heating assembly in the aerosol-generating device—is preferably arranged in thermal proximity to or thermal contact with aerosol-forming substrate. Alternatively or additionally, the electrical heating device itself may also be configured to act as temperature sensor. This will be described in more detail below.

In order to control the temperature of the aerosol-forming substrate, the controller may control an electrical power supply of the electrical heating device. Likewise, the controller may also control or act on means for controlling the generation of primary heat, for example a controllable supply system for supplying at least one reactant to the exothermic chemical. Such means will also be described in more detail below. Controlling the generation of primary heat is preferably open-loop or continuous or is preferably open-loop and continuous.

As used herein, the term "aerosol-forming substrate" relates to a substrate capable of releasing volatile compounds that can form an aerosol upon heating the aerosol-forming substrate. The aerosol-forming substrate may conveniently be part of an aerosol-generating article. The aerosol-forming substrate may be a solid or a liquid aerosol-forming substrate. The aerosol-forming substrate may comprise a tobacco-containing material containing volatile tobacco flavour compounds, which are released from the substrate upon heating. Alternatively or additionally, the aerosol-forming substrate may comprise a non-tobacco material. The aerosol-forming substrate may further comprise an aerosol former. Examples of suitable aerosol formers are glycerine and propylene glycol. The aerosol-forming substrate may also comprise other additives and ingredients, such as nicotine or flavourants. In particular, liquid aerosol-forming substrate may include water, solvents, ethanol, plant extracts and natural or artificial flavours. The aerosol-forming substrate may also be a paste-like material, a sachet of porous material comprising aerosol-forming substrate, or, for example, loose tobacco mixed with a gelling agent or sticky agent, which could include a common aerosol former such as glycerine, and then is compressed or molded into a plug.

As used herein, the term "chemical heating device is configured to generate heat by an exothermic chemical reaction" preferably includes directly generating and providing heat by an exothermic chemical reaction, that is using or providing heat directly released by an exothermic chemical reaction for heating the aerosol-forming substrate. Thus, the chemical heating device is configured to convert chemical energy directly into thermal energy.

In particular, the chemical heating device may be a fuel heater for combusting a fuel in exothermic redox chemical reaction between the fuel and an oxidant, for example oxygen. Preferably, the combustion may be catalyzed. Accordingly, the chemical heating device may be a fuel or a catalyst heater.

Preferably, the exothermic chemical reaction for generating primary heat may include at least one of the following reactions:

(a) oxidation of a fuel involving precious metal catalysts;
(b) oxidation of a fuel involving precious metal and transition oxides catalysts;
(c) an oxidation-reduction reaction of iron or iron compounds involving activated carbon catalysts;
(d) a metal oxidation-reduction reaction involving a metal reducing agent and a metal-containing oxidizing agent;
(e) a water initiated exothermic reaction;
(f) an exothermic crystallization of supersaturated solutions.

As to the reactions of type (a), precious metal catalysts typically cause a flameless oxidation of a fuel. The catalyst material may be generally dispersed or coated over porous articles which catalyst material catalyzes the fuel on contact. In order to increase the temperature of combustion, in particular for a complete combustion of fuel and for a significant reduction of carbon monoxide, the fuel oxidation may involve transition oxides along with conventional combustion catalysts, such as precious metal catalysts (see reactions of type (b)).

As to the reactions of type (c), a catalyzing effect of activated carbon may be used for initiating the oxidation-reduction reaction of iron or iron compounds.

With regard to the metal oxidation-reduction reactions according to type (d), the reactant materials may include a metal reducing agent and an oxidizing agent, such as metal-containing oxidizing agent. During the exothermic reaction, molecular oxygen is reduced by the compound that is oxidized. The metal reducing agent may comprise one of: molybdenum, magnesium, calcium, strontium, barium, boron, titanium, zirconium, vanadium, niobium, tantalum, chromium, tungsten, manganese, iron, cobalt, nickel, copper, zinc, cadmium, tin, and aluminum.

In water initiated exothermic reactions, water is used as reaction initiator for a chemical reactant, the latter may include one of: calcium oxide, sodium hydroxide, calcium chloride, magnesium sulfate, iron powder, sodium acetate trihydrate, barium hydroxide octahydrate, magnesium nitrate hexahydrate, magnesium chloride hexahydrate, anhydrous inorganic salts, or the like.

As to the exothermic crystallization of supersaturated solutions, supersaturated solutions are subjected to crystallization initiators to cause rapid crystallization. Heat is released during crystallization. The compounds used may be selected from compounds such as sodium acetate trihydrate, sodium sulfate, Glauber's salt or magnesium nitrate hexahydrate.

For the exothermic chemical reaction process to occur in, the chemical heating device may comprise a reaction chamber. Advantageously, the reaction location or volume of the exothermic chemical reaction is reaction-wise insulated from the aerosol-forming substrate. Therefore, the chemical heating device may further comprise a heat transfer element for transferring primary heat that is generated in the reaction chamber out of the reaction chamber such that the heat may be supplied to the aerosol-forming substrate outside the reaction chamber.

The heat transfer element may comprise a first portion that is at least partially arranged in the reaction chamber or exposed to the interior of the reaction chamber. Preferably, the first portion is at least partially arranged in the reaction chamber such that the exothermic chemical reaction occurs directly at or on the first portion or such that the exothermic chemical reaction directly affects the first portion.

The heat transfer element may further comprise a second portion that is thermally connected to the first portion and arranged or provided at least partially outside the reaction chamber. The second portion is preferably configured to get or to be brought at least partially into thermal proximity to or thermal contact with the aerosol-forming substrate. For this, the second portion may be optimized as to have a possibly large surface for transferring as much heat as possible to the aerosol-forming substrate.

The second portion may be configured to receive and preferably hold aerosol-forming substrate. For this, the second portion may comprise a cavity or a skewing member or may comprise a cavity and a skewing member. As an example, the second portion may include at least one of a blade, a skewer, a prong, a tine, a rod, a tube, a cavity, a pot, a cup or a hollow cylinder.

The second portion may be configured to get or be brought at least partially into thermal proximity to or thermal contact with a liquid conveyor, such as capillary active mesh or wick member. The liquid conveyor may be brought or is in contact with liquid aerosol-forming substrate. In general, the liquid conveyor is part of the overall aerosol-generating device rather than part of the heating assembly. Of course, it is also possible that the liquid conveyor is part of the heating assembly. The heat transfer element, preferably the second portion, may comprise at least one liquid conveyor configured to get into contact with liquid aerosol-forming substrate.

Preferably, the heat transfer element is a thermal conductor comprising a thermally conductive material. The heat transfer element may be capable of storing heat. Preferably, the heat transfer element comprises a material having a high specific heat capacity and preferably also a good thermal conductivity. For example, the heat transfer element may comprise a metal, in particular copper, stainless steel, or aluminum, or a combination of metals.

The heat transfer element may be fed through a wall of the reaction chamber such that the first portion is at least partially arranged in the reaction chamber or exposed to the interior of the reaction chamber, and that the second portion is arranged or provided at least partially outside the reaction chamber.

The heat transfer element may comprise at least a portion of a wall of the reaction chamber, having an inner surface exposed to the interior of the reaction chamber. An outer surface may be configured to get at least partially into thermal proximity to or thermal contact with the aerosol-forming substrate, corresponding to the above mentioned second portion. Preferably, the first and the second portion of the heat transfer element are formed integrally. Alternatively, the outer surface may be thermally connected to a separate part of the heat transfer element that is configured to get at least partially into thermal proximity to or thermal contact with the aerosol-forming substrate. This other part may correspond to the above mentioned second portion.

The heat transfer element, the first portion and the second portion, respectively, may comprise several configurations, shapes and materials. In particular, the heat transfer element, the first portion and the second portion, respectively, may have any cross-sectional shape, for example round, triangular, rectangular, quadratic, or polyhedral. At least one of the heat transfer element, the first portion and the second portion may be at least partially hollow or at least partially massive. The first portion and the second portion may be different from each other in at least one of the following features: configuration, shape and material.

As an example, the heat transfer element may be blade-shaped or may comprise a blade, in particular made of metal. A first portion of the blade may be at least partially arranged in the reaction chamber or exposed to the interior of the reaction chamber, whereas a second portion of the blade may be arranged or provided at least partially outside the reaction chamber. In particular, the blade may be fed or pass through a wall of the reaction chamber. Preferably, the second portion of the blade is configured to receive and preferably hold aerosol-forming substrate. For this, a free end of the second portion of the blade may be tapered, in particular in case of solid aerosol-forming substrates.

As another example, the heat transfer element may comprise a hollow cylinder, for example made of metal. In particular, a first axial portion of the cylinder may be at least partially arranged in the reaction chamber or exposed to the interior of the reaction chamber. The first axial portion of the cylinder may include at least a portion of a wall of the reaction chamber. A second axial portion of the cylinder may be arranged or provided at least partially outside the reaction chamber. Furthermore, a partition member may be provided to separate the interior surrounded by the first portion from the interior surrounded by the second portion. The partition member may be part of the reaction chamber or part of the heat transfer element or part of both, the reaction chamber and the heat transfer element. The interior of the second axial portion of the cylinder may be configured to receive and preferably hold aerosol-forming substrate. For this, a front end of the second axial portion of the cylinder may be open.

The heat transfer element may comprise a pot in thermal contact with reaction chamber. In particular, a bottom of the pot may be a portion of a wall of the reaction chamber, wherein the outer surface of the bottom is exposed to the interior of the reaction chamber. The interior of the pot may be configured to receive and preferably hold aerosol-forming substrate.

The chemical heating device may comprise at least one reactant reservoir for storing at least one reactant of the exothermic chemical reaction and for supplying the at least one reactant to the reaction chamber. The reactant reservoir may be fillable, for example via a fill nozzle or an inlet. The reactant reservoir may be connected to the reaction chamber via at least one feed pipe, tube or channel.

The chemical heating device may comprise pressure means for pressurizing the reactant in the reactant reservoir to facilitate the supply of the reactant to the reaction chamber. Such pressure means may comprise a micro-pump or a pressurized gas or a loaded spring exerting pressure on the reactant in the reactant reservoir.

The feed pipe, tube or channel may comprise a plurality or an array of capillary channels, causing the reactant to be dispensed automatically by capillary forces. The number of capillary channels may be used to control or predetermine the flow rate. Advantageously, capillary channels do not need any pressure means to facilitate the supply of the reactant to the reaction chamber. This simplifies the chemical heating device.

The reaction chamber may comprise at least one of an inlet, an orifice or an opening. For example, the reaction chamber may include an inlet connected to the reactant reservoir for receiving at least one reactant of the exothermic chemical reaction. In particular, a feed pipe, a tube or a channel connecting a reactant reservoir to the reaction chamber may be coupled to an inlet of the reaction chamber.

The reaction chamber may include an inlet for air supply, in particular oxygen. Furthermore, the reaction chamber may comprise at least one outlet, in particular at least one outlet for discharging reaction products of the exothermic chemical reaction from the reaction chamber. As an example, the reaction chamber may comprise at least one exhaust outlet.

The chemical heating device may comprise a thermal barrier between the reaction chamber and the reactant reservoir for thermal shielding. In particular, a feed pipe, a tube or a channel connecting a reactant reservoir to the reaction chamber may be fed through the thermal barrier.

For example, in case of a liquid or gaseous fuel heater, the heater may comprise a fuel reservoir for dispensing fuel to the reaction chamber. For this, the reaction chamber may be in fluid communication with the fuel reservoir via a feed pipe. The fuel in the reservoir may be refillable via a fill nozzle. Furthermore, the chemical heating device may provide pressure means to pressurize fuel in the fuel reservoir so that fuel may be easily dispensed into the reaction chamber, for example upon opening a fuel valve for controlling the fluid communication between the fuel reservoir and the reaction chamber.

The heating assembly may further comprise means for controlling the generation of primary heat, in particular for adjusting or limiting the generation of primary heat. These means may include a controllable supply system for supplying at least one reactant to the exothermic chemical reaction and for controlling the generation of primary heat. The controllability of the supply system may allow for presetting the generation of primary heat, in particular for limiting the generation of the primary heat to a preset limit. Alternatively or additionally, the controllable supply system may allow for adjusting the generation of primary heat during use of the heating assembly or the aerosol-generating device, respectively. The controllable supply system may comprise at least one of an inlet valve and an outlet valve for controlling the flow rate through the at least one inlet or outlet, respectively. In particular, the controllable supply system may comprise at least one inlet valve for controlling the supply of reactant from the reactant reservoir to the reaction chamber or an air inlet valve for controlling the supply of air into the reaction chamber. The pressure means for pressurizing the reactant in the reactant reservoir may be part of or may be affected by the means for controlling the generation of primary heat or the controllable supply system, respectively.

The heating assembly may further comprise means for controlling the supply of primary heat to the aerosol-forming substrate. Such means may for example comprise a displacing device or a displacing mechanism for reversibly displacing the heat transfer element to get into thermal proximity to or thermal contact with the aerosol-forming substrate and out. Such means may also comprise a displacing device or a displacing mechanism for reversibly displacing the aerosol-forming substrate to get into thermal proximity to or thermal contact with the heat transfer element and out. Such means may also comprise a displacing device or a displacing mechanism for reversibly displacing the heat transfer element, in particular the first portion of the heat transfer element, to get into thermal proximity to or thermal contact with the reaction chamber and out.

In general, the electrical heating device according to the invention may be any device configured to convert electrical energy into heat.

For example, the electrical heating device may be an inductive heater comprising a generator for producing an alternating magnetic field, and a susceptor material which is inductively heatable by the alternating magnetic field and positioned relative to the generator so as to be heatable by the alternating magnetic field. For heating, the aerosol-forming substrate is to be brought in thermal proximity to the susceptor material. Therefore, the heating assembly of the invention may be configured such that in use of the heating assembly in an aerosol-generating device, the susceptor material is advantageously in thermal proximity to or thermal contact with aerosol-forming substrate. Alternatively, the inductive heater may only include a generator for producing an alternating magnetic field, whereas the susceptor material is integrated in the aerosol-forming substrate to be heated.

Preferably, the electrical heating device is a resistive heating device comprising a resistive heating element. The resistive heating element heats up when electrical current is passed through due to its immanent ohm resistance or resistive load. For this, the resistive heating element may be connected to an electrical power supply. The power supply may be a DC voltage source, for example a battery, preferably a rechargeable battery, such as a Lithium-ion battery.

The electrical power supply may be part of electrical heating device or of the heating assembly in general. Alternatively, the electrical heating device may be part of the aerosol-generating device which the heating assembly of the invention is provided for. Regardless of whether the electrical power supply is part of the aerosol-generating device or the heating assembly, the electrical power supply may be also used for other purposes, for example to run a controller of the heating assembly or an overall controller of the aerosol-generating device.

The resistive heating element may comprise at least one of a resistive heating wire, a resistive heating track, a resistive heating grid or a resistive heating mesh.

The resistive heating element may be configured to get or to be brought at least partially into thermal proximity to or thermal contact with the aerosol-forming substrate. The resistive heating element may be configured to get or be brought at least partially into thermal proximity to or thermal contact with a liquid conveyor that in turn can be brought or is in contact with liquid aerosol-forming substrate.

Analogous to the chemical heating device, the electrical heating device may comprise a heat transfer element. Likewise, the heat transfer element may include a first portion which is in thermal contact with the resistive heating element or which the resistive heating element is arranged on. The heat transfer element may also include a second portion configured to get or to be brought at least partially into thermal proximity to or thermal contact with aerosol-forming substrate. Further features and advantages of the heat transfer element have been described with regard to the heat transfer element of the chemical heating device and will not be repeated.

In general, the chemical heating device and the electrical heating device may be separate and independent, in particular with regard to supplying heat from the respective heating device to the aerosol-forming substrate. By way of example, the heating assembly may be configured such that the chemical heating device and the electrical heating device may supply heat to the aerosol-forming substrate at different locations or from different directions.

Yet, the heating assembly is preferably configured such that the chemical heating device and the electrical heating device may supply heat to the aerosol-forming substrate at about the same location or same locations. Hence, the heating assembly may be preferably configured such that the chemical heating device and the electrical heating device provide a joined or merged or coalesced heat input to the aerosol-forming substrate. This provides a much more homogenous heating of the aerosol-forming substrate. Even more, as the temperature of the aerosol-forming substrate depends on the accumulation of the primary heat and the secondary heat when used in combination, a joined or merged or coalesced heat input helps to ease controlling the temperature of the aerosol-forming substrate, in particular to adjust the temperature of the aerosol-forming substrate to the target temperature.

Advantageously, the resistive heating element may be arranged at least partially within or on the heat transfer element of the chemical heating device. Preferably, the resistive heating element may be arranged within or on the second portion of the heat transfer element. To avoid electrical short circuits, the heat transfer element may comprise an electrically insulating coating or substrate which receives or supports the resistive heating element. Alternatively or additionally, the resistive heating element itself may comprise an electrically insulating coating or substrate. In both cases, the coating or substrate may preferably comprise a ceramic material. As an example, the heat transfer element of the chemical heater may comprise a blade having a metallic core member that extends along the first and second portion. Along the second portion, the metallic core member may be additionally sandwiched between two ceramic cover members. The outer surface of at least one cover member may be coated with a metal track, for example made of platinum, as resistive heating element. In order to maximize the heating capacity, the metal track may be meander-like or spiral-like.

Advantageously, the resistive heating element may be configured to act as temperature sensor. This possibility relies on the temperature dependent resistance characteristic of the resistive material used to build up the resistive heating element. The heating device may further comprise a readout device for measuring the resistance of the resistive heating element. The readout device may be part of a controller of the heating assembly or a controller of the aerosol-generating device. The measured temperature directly corresponds to the actual temperature of the heating element. The measured temperature may also be indicative for the actual temperature of the aerosol-forming substrate, depending on the positioning of the heating element relative to the aerosol-forming substrate to be heated and the given characteristics of the heat supply from the electrical heating device to the aerosol-forming substrate. Hence, the resistive heating element may be used as temperature sensor for controlling the temperature of the aerosol-forming substrate, in particular for adjusting the actual temperature of the aerosol-forming substrate to the target temperature.

The heating assembly may comprise an energy converting device for converting heat generated by the chemical heating device into electrical power. Advantageously, such a device may be used for heat recovery. In particular, the energy converting device may be configured for converting excess or waste heat generated by the chemical heating device that cannot be provided to the aerosol-forming substrate. The energy converting device preferably includes at least one thermoelectric generator. Thermoelectric generators are typically based upon the Seebeck principle. As compared to heat engines, thermoelectrical generators have no moving parts and are less bulky.

Preferably, the energy converting device is operatively connected to the electrical heating device for supplying the electrical heating device with converted electrical power. In particular, the converted electrical power may be fed to a power supply used to run the electrical heating device. As an example, the energy converting device may be operatively connected to a battery in order to feed in converted electrical power for recharging purposes. Of course, the energy converting device may also be operatively connected to another electrical component of the heating assembly or the aerosol-generating device. For example, such a component may be a global power supply of the aerosol-generating device, such as a global battery, or a controller of the heating assembly or a controller of the aerosol-generating device.

The energy converting device may assign to the aerosol-generating device or to the heating assembly itself.

The energy converting device may be advantageously arranged in thermal proximity to or thermal contact with the reaction chamber. Analogous to the first portion of the heat transfer element, the energy converting device may be at least partially arranged in the reaction chamber or exposed to the interior of the reaction chamber. For example, the energy converting device may be at least a portion of a wall of the reaction chamber. The energy converting device and the heat transfer element of the chemical heating device may tap the reaction chamber at different locations or regions.

According to the invention there is also provided an aerosol-generating device for generating an aerosol by heating aerosol-forming substrate. For heating the aerosol-forming substrate, the aerosol-generating device comprises a heating assembly according to the invention and as described herein.

Further features and advantages of the aerosol-generating device according to the invention have been described with regard to the heating assembly and will not be repeated.

The aerosol-generating device may comprise a controller which may be an overall controller. The controller may be used for controlling the temperature of the aerosol-forming substrate, in particular to adjust the temperature of the aerosol-forming substrate to the target temperature. The controller of the aerosol-generating device may include or be the controller of the heating assembly. The controller of the aerosol-generating device may also be used to control or act on the means for controlling the generation of primary heat, in particular to control or act on the controllable supply system. The controller of the aerosol-generating device may also be used to control or act on the means for controlling the supply of primary heat.

The aerosol-generating device may comprise a global power supply that is preferably also used to supply the heating assembly with electrical power, in particular the electrical heating device.

Furthermore, the aerosol-generating device may comprise components for receiving, accommodating and preferably holding aerosol-forming substrate. As an example, the aerosol-generating device may include a cavity for receiving solid aerosol-forming substrate. Likewise, the aerosol-generating device may comprise a reservoir for liquid aerosol-forming substrate. In that case, the aerosol-generating device may also comprise a liquid conveyor for conveying liquid aerosol-forming substrate, for example a capillary active mesh or wick member. Preferably, the liquid conveyor may be brought into or is in contact with heating assembly to be supplied with primary and secondary heat.

According to the invention there is also provided a method for generating an aerosol by heating aerosol-forming substrate, in particular by using a heating assembly or an aerosol-generating device according to the invention and as describe herein. The method comprises at least one of a sequential or a parallel performance of the following steps:

generating primary heat by an exothermic chemical reaction and supplying the primary heat to the aerosol-forming substrate for heating the aerosol-forming substrate;

electrically generating secondary heat and supplying the secondary heat to the aerosol-forming substrate for heating the aerosol-forming substrate.

In particular, the method according to the invention may comprise a combination of a sequential and a parallel performance of the above steps, i.e. a combination of a sequential and a parallel use of primary heat and secondary heat.

Advantages of the method according to the invention have been described relating to the heating assembly and the aerosol-generating device according to the invention and will not be repeated.

As already described with regard to the heating assembly, the primary heat and the secondary heat may be used sequentially for sequentially heating the aerosol-forming substrate. In particular, the primary heat and the secondary heat may be used each for heating the aerosol-forming substrate during different phases of generating an aerosol. The primary heat may be used prior to using the secondary heat, or vice versa. In general, the method may comprise any sequence of using primary heat and secondary heat, for example a sequence including the alternating use of primary heat and secondary heat. Preferably, the primary heat and the secondary heat may be used each to heat the aerosol-forming substrate to different temperatures during different phases, which allows for controlling the generation of aerosol over time. As an example, the primary heat may be used for heating the aerosol-forming substrate during a first phase of aerosol generation according to a first temperature profile, and the secondary heat may be used for heating the aerosol-forming substrate during a second phase of aerosol generating according to a second temperature profile. The first and second temperature profiles may be such that the temperature increases from an initial temperature to a first temperature during the first phase, and drops below the first temperature and then again increases during the second phase.

Alternatively, the primary heat and the secondary heat may be used in parallel for combined heating of the aerosol-forming substrate. In particular, the primary heat may be used for heating the aerosol-forming substrate to a pre-target temperature and the secondary heat may be used in addition to the primary heat for further heating the aerosol-forming substrate to a target temperature above the pre-target temperature.

Analogous to the heating assembly, the method may further comprise the step of adjusting the temperature of the aerosol-forming substrate to the target temperature by controlling at least the generation of secondary heat. Likewise, the method may further comprise the step of converting heat from the exothermic chemical reaction into electrical power and providing or using the converted electrical power for electrically generating secondary heat.

The method may further comprise the step of controlling at least one of the generation or the supply of primary heat. The generation of primary heat may be controlled for example by controlling the supply of at least one reactant of the exothermic chemical reaction. The supply of primary heat may be controlled by using means as described above with regard to the heating assembly.

The method may further comprise the step of controlling the supply of at least one of the primary heat and the secondary heat to the aerosol-forming substrate.

The invention will be further described, by way of example only, with reference to the accompanying drawings, in which.

Figure 1:
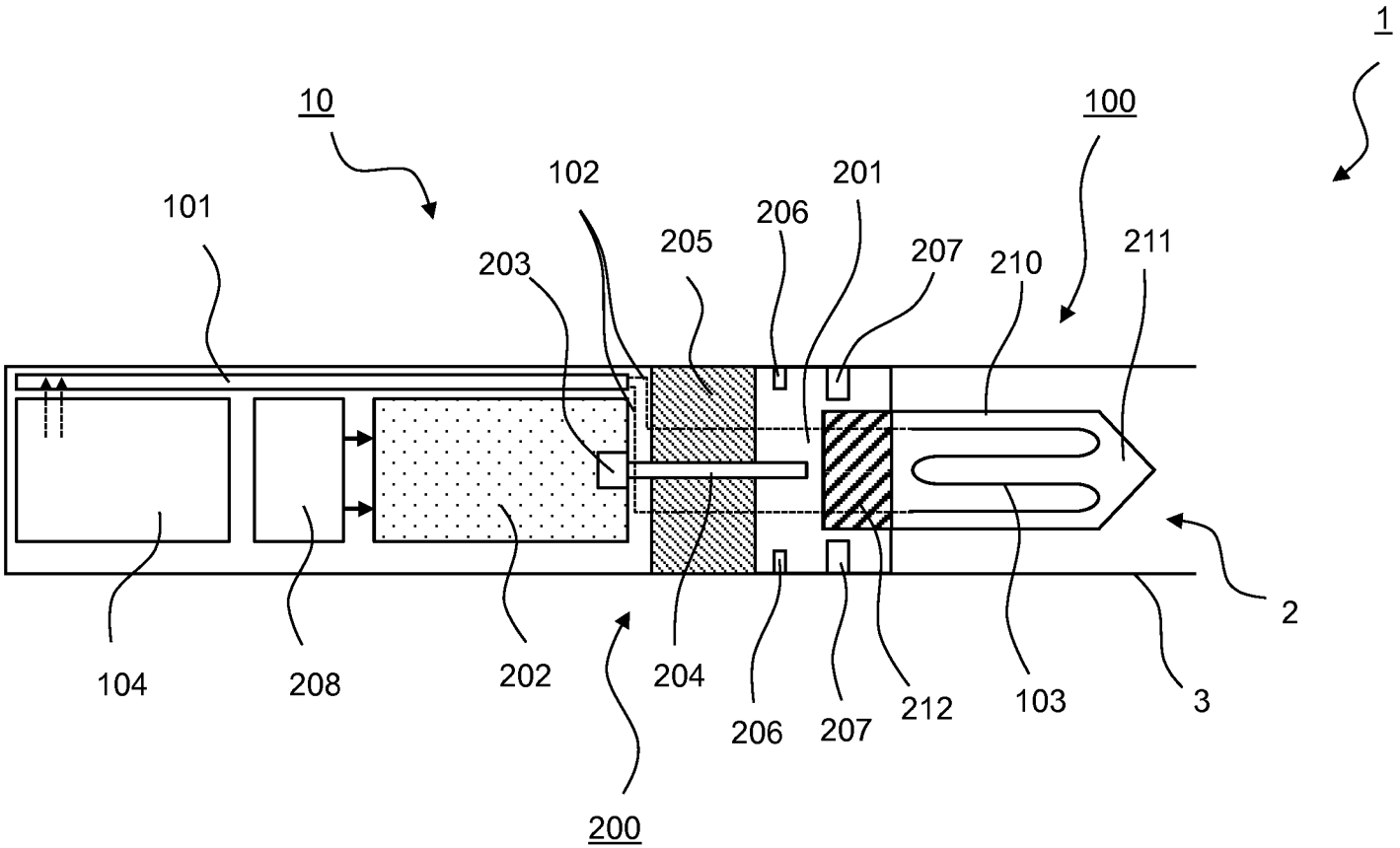
FIG. 1 is a schematic illustration of an aerosol-generating device comprising a hybrid heating assembly according to a first embodiment of the invention.

FIG. 1 schematically shows an aerosol-generating device 1 comprising a heating assembly 10 according to a first embodiment to the invention. The heating assembly 10 comprises two heating devices, a chemical heating device 200 and an electrical heating device 100, for combined heating of aerosol-forming substrate. The chemical heating device 200 provides primary heat by an exothermic chemical reaction for pre-heating of the aerosol-forming substrate to a pre-target temperature which is below a desired target temperature of the aerosol-forming substrate to form an aerosol. In order to reach the target temperature, the electrical heating device 100 provides secondary heat in addition to the primary heat. Due to the high energy density of exothermic chemical reactions, the chemical heating device preferably provides a major amount of heat for a coarse adjustment of the temperature, whereas the electrical heating device preferably provides a minor amount of heat used for fine adjustment of the temperature.

With regard to the embodiment according to FIG. 1, the chemical heating device 200 is a catalytic heater configured to generate primary heat by catalyzed fuel combustion in a reaction chamber 201. For this, fuel is provided in a reactant reservoir or fuel reservoir 202 that is in fluid communication with the reaction chamber 201 via a dispensing tube 204. The fuel reservoir 202 may be refillable via a fill inlet (not shown). The chemical heating device 200 also comprises pressure means 208 for pressurizing the fuel in the fuel reservoir 208, causing the pressure in the fuel reservoir 202 to be higher than in the reaction chamber 201, the latter being typically at atmosphere pressure. Due to this, fuel is automatically dispensed via the dispenser tube 204 into the reaction chamber 201 upon opening a valve 203 that is configured to control the fuel flow from the reservoir 202 into the reaction chamber 201.

Apart from the inlet for the dispenser tube 204, the reaction chamber 201 comprises air inlets 207 for providing oxygen for the catalytic reaction. Furthermore, the reaction chamber 201 comprises outlets 206 for discharging water and exhaust gases of the catalytic reaction to the environment.

A thermal barrier 205 is provided between the reaction chamber 201 and the fuel reservoir 202 for thermal shielding such that the fuel reservoir and other components beyond the thermal barrier 205 stay at reasonable temperatures.

In the reaction chamber 201, the fuel is combusted by a catalyzed exothermic reaction, thereby generating primary heat for heating aerosol-forming substrate.

The fuel may be any organic compound capable of supplying energy through its oxidation. For example, the fuel may comprise one of a short chain alcohol (methanol, ethanol, propanol or isopropanol and butanol and isomers), ketone, aldehyde or carboxylic acid that is readily oxidized. Catalytically combustible gases may comprise, for example, one of hydrogen, methane, propane, pentane, ether, ethane, or butane and their isomers.

The catalyst used to catalyze the fuel combustion may be a catalyst having high oxygen reduction reactivity. The catalyst may comprise, for example, one or more metals or an alloy of one or more metals selected from the group comprising Fe, Co, Ni, Rh, Pd, Pt, Cu, Ag, Au, Zn and Cd. In particular, the catalyst may comprise at least one precious metal, at least one transition metals or a combination of at least one metal and at least one transition metal, for example, Pt, Pd, Rh, Ir, Ru, Ni, Os, Re, Co, Fe, Mn, Ag, Cu. The catalyst may be supported for example on a surface of a substrate article within the reaction chamber 201.

Primary heat generated by the catalyzed exothermic reaction of the fuel-oxygen mixture is transferred via a heat transfer element 210 from the reaction chamber 201 to a cavity 2 defined within a housing 3 of the aerosol-generating device 1. The cavity 2 is open at the proximal end of the aerosol-generating device 1 for receiving an aerosol-generating article that includes the aerosol-forming substrate to be heated. For example, the aerosol-forming substrate may be compressed or molded into a plug forming the aerosol-generating article (not shown).

Figure 2:
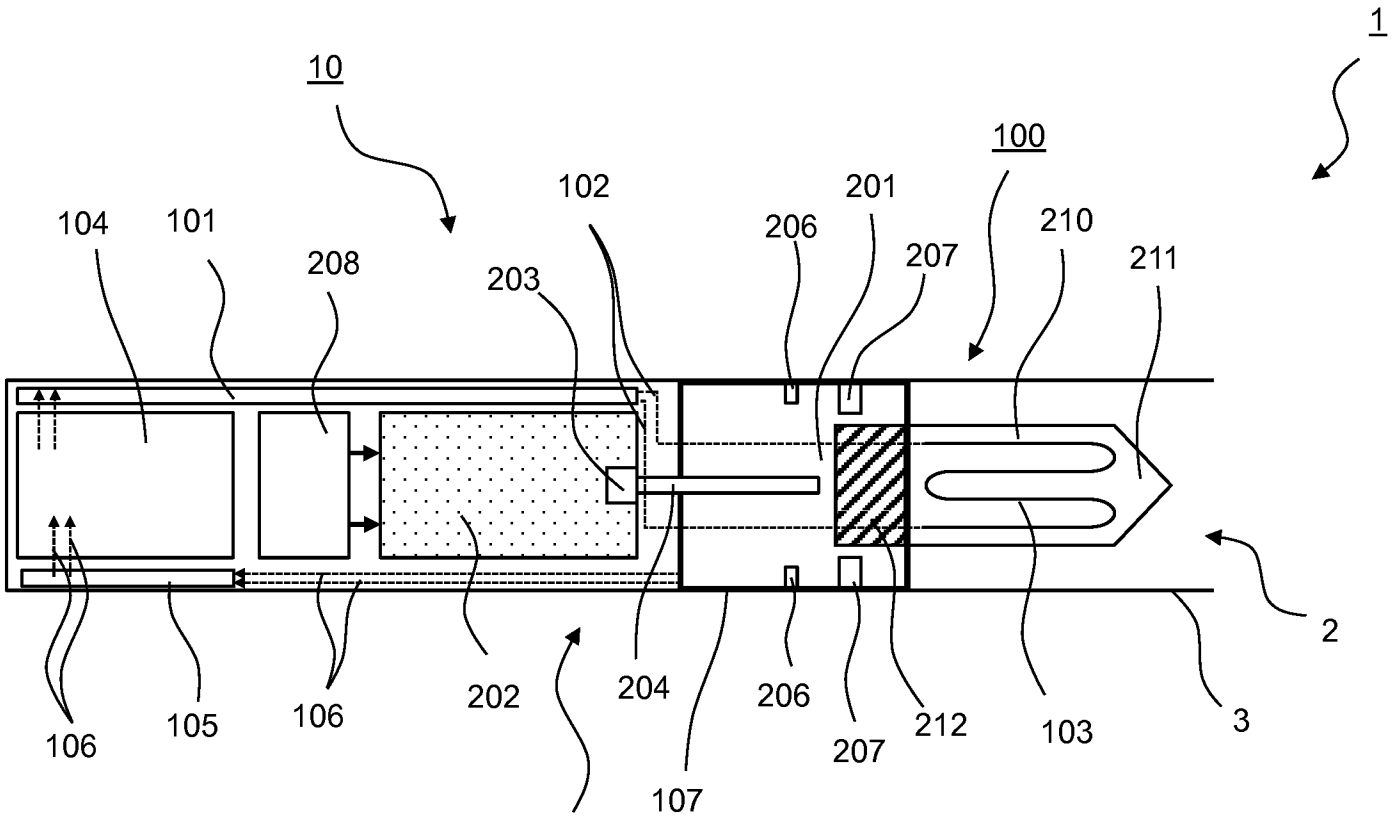
FIG. 2 is a schematic illustration of an aerosol-generating device comprising a hybrid heating assembly according to a second embodiment of the invention.
Figure 3:
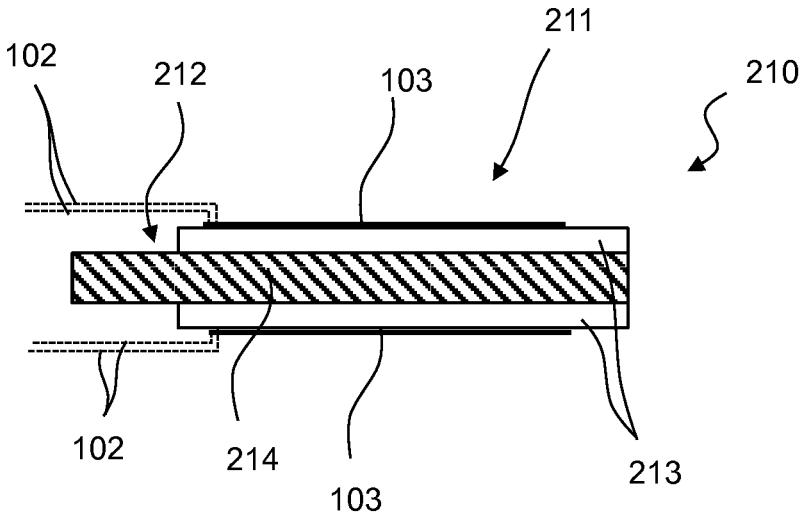
FIG. 3 shows a cross-section through a portion of the hybrid heating assembly according to FIG. 1 and FIG. 2.
Figure 4:
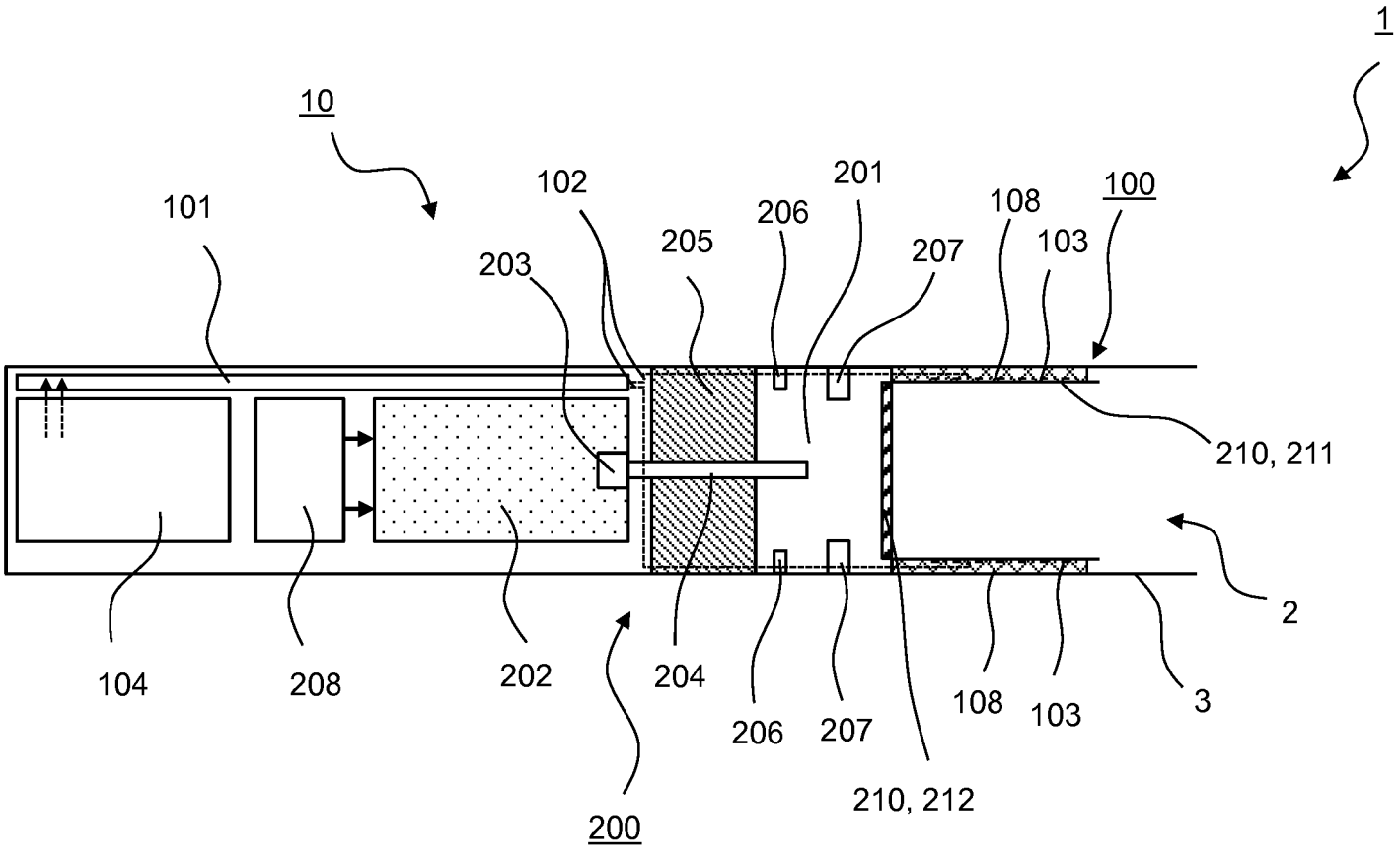
FIG. 4 is a schematic illustration of an aerosol-generating device comprising a hybrid heating assembly according to a third embodiment of the invention.
Figure 5:
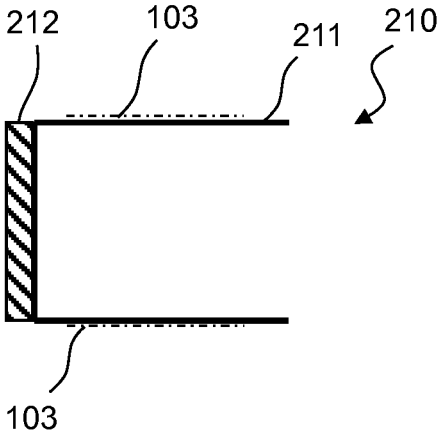
FIGS. 5-8 show details of the hybrid heating assembly according to FIG. 4.
Figure 6:
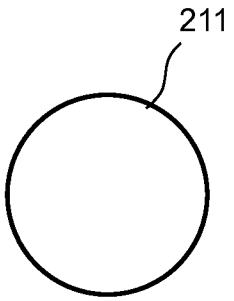

FIG. 3 shows further details of the heat transfer element 210 used within the embodiment shown in FIG. 1 and FIG. 2. The heat transfer element 210 comprises a metallic blade 214 fed through the wall of the reaction chamber 201 next to the cavity 2. The heat transfer element 210 comprises a first portion 212 which is arranged in the reaction chamber 201 and on which the catalyzed exothermic reaction is preferably performed directly in order to optimize heat transfer. A second portion 211 of the heat transfer element 210 is arranged in the cavity 2 separated from the reaction chamber 201. The proximate end of the second portion 211 is tapered, thus facilitating to plug on and hold an aerosol-generating article when it is pushed into the cavity 2 of the housing 3. By this, the aerosol-forming substrate may be brought into direct thermal contact with the catalyzed exothermic reaction, however, without direct contact to the reaction itself.

Further referring to FIGS. 1 and 3, the heat transfer element 210 comprises ceramic cover members 213 sandwiching the metallic core of the blade 214 along the second portion 211. The ceramic cover members 214 provide an electrically non-conductive substrate to support an electrically conductive heating element 103 which is part of the resistive heating device 100. In the present embodiment, the heating element comprises metal tracks 103 on both sides of the blade-like heat transfer element 210. In order to optimize heat transfer to the aerosol-forming substrate, the metal tracks 103 are arranged in meandering configuration. Alternatively, the tracks may be arranged in a spiral configuration. To electrically generate heat, the heating element 103 consists of a resistive material. Preferably, the metal tracks are made of platinum.

The tracks may be heated up to the desired target temperature by running an electrical current through. For this, the tracks on both sides of the heat transfer element 210 are connected in parallel via electrical connections 102 to a power supply 104. In present embodiment, the power supply is a rechargeable battery, for example a Lithium-ion battery.

Advantageously, the heating tracks 103 may simultaneously be used to measure the temperature on the surfaces of the heat transfer element 210 which is indicative for the actual temperature of an aerosol-forming substrate attached thereto. Assuming that the material of the heating element 103 has an appropriate temperature coefficient of resistance characteristic, the temperate may be determined by measuring the resistance of the heating element 103, for example by measuring the voltage across and the current through the electrically conductive heating element 103. Using the heating element as temperature sensor may help to reduce the number of components within the heating assembly 10 since no separate temperature sensor will be required. However, in addition or alternatively, the heating assembly 10 may also comprise a separate temperature sensor, of course.

A controller 101, such as a micro controller unit implemented on an electronic circuit board, may be used for controlling the temperature of the aerosol-forming substrate. According to the invention, this is realized by controlling at least the secondary heat provided by the electrically heating device 100 on top of the primary heat provided by the chemical heating device 200. Therefore, the controller 101 is operatively connected at least to the electrical heating device 100. In particular, the controller 101 may be configured to determine the actual temperature on the surface of the heat transfer element 210 by determining the temperature dependent resistance of the heating element 103 as described above. The temperature on the surface of the heat transfer element 210 is indicative of the actual temperature of aerosol-forming substrate. Based upon a comparison of the actual temperature with the desired target temperature of the aerosol-forming substrate or the corresponding temperatures on the heat transfer element, respectively, the controller 101 is further configured to control the electrical power from the power supply 104 to the electrically heating element 103. The heat electrical power is preferably supplied intermittently to the heating element 103. Advantageously, the control of secondary heat for fine adjustment of the temperature of the aerosol-forming substrate is closed-loop.

The controller 101 may be also used for controlling the recharge of the power supply 104, for example the recharge of the battery from an external power supply. The controller may be also used for controlling the generation of primary heat, for example by controlling the fuel valve 203, thereby controlling the amount of fuel to be dispensed from the fuel reservoir 202 to the reaction chamber 201. For this, the controller 101 may access a table (for example stored in a storage unit of the controller 101) which contains pre-calibrated fuel flow rates versus generated primary heat in the reaction chamber 201. Additionally or alternatively, the controller 101 may also act on the air inlet 207 to modulate the oxygen supply into the reaction chamber 201. The generation of primary heat is limited to a pre-target temperature well below the actual target temperature so that a complete shut-off of secondary heat will be enough to easily reduce the actual temperature to reasonable temperatures in case of overheating. Preferably, the pre-target temperature is about 250° C., whereas the target temperature is typically between 300° C. and 350° C.

In general, the controller 101 and/the power supply 104 may be either part of the heating assembly 10 or the overall aerosol-generating device 1.

FIG. 2 schematically shows an aerosol-generating device 1 comprising a heating assembly 10 according to a second embodiment to the invention. The basic concept of generating and supplying first and second heat to the aerosol-forming substrate is similar to the first embodiment according to FIG. 1. Therefore, identical features are denoted with identical reference numerals unless otherwise explicitly indicated.

In contrast to the first embodiment according to FIG. 1, the heating assembly according to the second embodiment comprises an energy converting device 107 for converting heat generated by the chemical heating 200 device into electrical power. In the present embodiment, the energy converting device 107 may comprise at least one thermoelectrical generator capable of generating electricity from a temperature gradient based on the Seebeck principle. Such thermoelectrical generator are generally known from prior art. For this, the thermoelectrical generator may be arranged between the fuel reservoir and the reaction chamber in lieu of the thermal barrier 205 in the first embodiment according to FIG. 1. Alternatively or additionally, the thermoelectrical generator may be arranged laterally attached to reaction chamber, having its "cold" side facing outwards from the reaction chamber 201.

Preferably, electrical power generated by the energy converting device 107 is fed into the power supply 104 of the heating assembly 10 of the overall aerosol-generating device 1. In the present embodiment, the heating assembly 10 comprises a battery charger 105 using the electricity provided by the energy converting device 107 to at least partially recharge the battery 104. For this, the battery charger 105 is operatically connected to the energy converting device 107 and the power supply 104 via electrical connections 106.

FIGS. 4, 5, 6, 7 and 8 show an aerosol-generating device 1 comprising a heating assembly 10 according to a third embodiment to the invention. The basic concept of generating and supplying first and second heat to the aerosol-forming substrate is similar to the first and second embodiment according to FIG. 1 and FIG. 2. Therefore, identical features are denoted with identical reference numerals unless otherwise explicitly indicated.

In contrast to the embodiments according to FIG. 1 and FIG. 2, the heating assembly 10 according to this third embodiment comprises a cup-like heat transfer element 210.

The heat transfer element 210 comprises a plate-like first portion 212 (not shown in top view of FIG. 6 and perspective view of FIG. 8) and a hollow-cylindrical second portion 211. The first portion 212 may be attached to or may form a bottom of the second portion 211 (see cross-sectional view of FIG. 5).

The first portion 212 is at least partially arranged in or exposed to the reaction chamber 201 such that the exothermic chemical reaction occurs directly on the exposed surface of the first portion 212. The first portion 212 is made of metal allowing for efficiently transferring primary heat to the aerosol-forming substrate which may be received within the hollow-cylindrical second portion 211.

The second portion 211 is also involved in transferring of primary heat. For this, the hollow-cylindrical second portion 211 is made of a ceramic material, providing good thermal conductivity and high thermal resistance.

Figure 7:
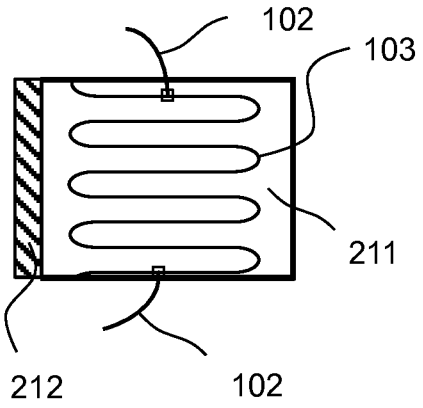
Figure 8:
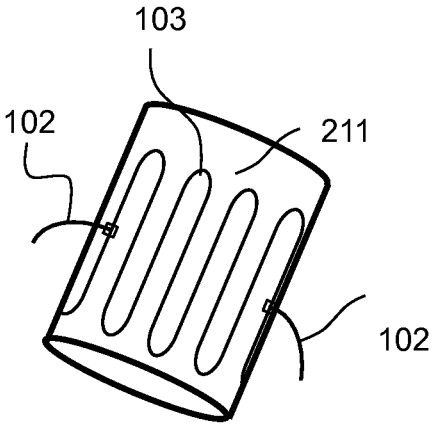

As can be seen in particular from the side view of FIG. 7 and the perspective view of FIG. 8, the outside surface of the electrically non-conductive second portion 211 supports an electrically conductive heating element 103 which is part of the resistive heating device 100. In the present embodiment, the heating element comprises a metal track 103 (dashed-dotted-line in FIG. 4 and FIG. 5) circumferentially arranged in meandering configuration on the outside surface of the second portion 211. The meandering configuration advantageously optimizes heat transfer from the heating element 103 to the aerosol-forming substrate via the second portion 211. In the same way as for the heating assemblies shown in FIG. 1 and FIG. 2, the track 103 may be heated up by running an electrical current through. For this, the track is connected via electrical connections 102 to a power supply 104.

In order to avoid a user of the device to sustain contact burns, a thermal barrier 108 is arranged in the clearance between the outside surface of the second portion 211 and the inner surface of the cavity 2 defined at the distal end of the housing 3 of the aerosol-generating device 1.

The invention claimed is:

1. A heating assembly of an aerosol-generating device for heating aerosol-forming substrate, the heating assembly comprising:

a chemical heating device configured to generate primary heat by an exothermic chemical reaction and to supply the primary heat to an aerosol-forming substrate for heating the substrate, an electrical heating device configured to electrically generate and supply secondary heat to the aerosol-forming substrate for heating the substrate, and a controller operatively connected at least to the electrical heating device for controlling the temperature of the aerosol-forming substrate.

2. The heating assembly according to claim 1, wherein the heating assembly is configured for at least one of:

parallel heating of the aerosol-forming substrate by using the chemical heating device and the electrical heating device in combination;

sequential heating of the aerosol-forming substrate using the chemical heating device and the electrical heating device sequentially.

3. The heating assembly according to anyone of claim 1, wherein the chemical heating device is configured for heating the substrate to a pre-target temperature, and the electrical heating device is configured for further heating the substrate to a target temperature above the pre-target temperature in addition to the chemical heating device.

4. The heating assembly according to claim 1, wherein the chemical heating device comprises a reaction chamber for executing the exothermic chemical reaction and a heat transfer element for transferring primary heat out of the reaction chamber.

5. The heating assembly according to claim 1, wherein the heating assembly comprises a controllable supply system for supplying at least one reactant to the exothermic chemical reaction and for controlling the generation of primary heat.

6. The heating assembly according to claim 1, wherein the electrical heating device comprises a resistive heating element.

7. The heating assembly according to claim 1, further comprising an energy converting device for converting heat generated by the chemical heating device into electrical power.

8. The heating assembly according to claim 7, wherein the energy converting device is operatively connected to the electrical heating device for supplying the electrical heating device with converted electrical power.

9. An aerosol-generating device comprising a heating assembly according to claim 1.

10. A method for generating an aerosol by heating an aerosol-forming substrate, the method comprising at least one of a sequential or a parallel performance of the following steps:

generating primary heat by an exothermic chemical reaction and supplying the primary heat to the aerosol-forming substrate for heating the substrate;

electrically generating secondary heat and supplying the secondary heat to the aerosol-forming substrate for heating the substrate; and adjusting the temperature of the aerosol-forming substrate to a target temperature by controlling at least the generation of secondary heat.

11. The method according to claim 10, wherein the primary heat and the secondary heat are used for heating the aerosol-forming substrate during different phases of generating an aerosol.

12. The method according to claim 10, wherein the primary heat is used for heating the aerosol-forming substrate to a pre-target temperature and wherein the secondary heat is used in addition to the primary heat for further heating the aerosol-forming substrate to the target temperature above the pre-target temperature.

13. The method according to anyone of claim 10, further comprising the step of converting heat from the exothermic chemical reaction into electrical power and providing the converted electrical power for electrically generating secondary heat.

* * * * *